United States Patent [19]

Levenberg et al.

[11] 4,449,631

[45] May 22, 1984

[54] TAMPER PROOF PACKAGING

[76] Inventors: Nat Levenberg; Alvin Levenberg, both of 1345 Halsey St., Brooklyn, N.Y. 11237

[21] Appl. No.: 473,126

[22] Filed: Mar. 7, 1983

[51] Int. Cl.[3] ..... B65D 85/56; B65D 81/20; B65D 33/34

[52] U.S. Cl. ..... 206/459; 206/484; 206/522; 206/497; 206/807

[58] Field of Search ..... 206/484, 807, 459, 439, 206/522, 497; 229/62

[56] References Cited

U.S. PATENT DOCUMENTS

| | | | |
|---|---|---|---|
| 2,074,490 | 3/1937 | Schwartz | 206/807 |
| 2,821,951 | 2/1958 | Carver | 206/459 |
| 3,038,593 | 6/1962 | Root et al. | 206/522 |
| 3,090,484 | 5/1963 | Scholl . | |
| 3,148,772 | 9/1964 | Saffir | 206/459 |
| 3,340,669 | 9/1967 | Farquharson | 206/522 |
| 3,463,307 | 8/1969 | Caplan . | |
| 3,899,295 | 8/1975 | Halpern | 23/253 |
| 3,933,304 | 1/1976 | Judd | 229/62 |
| 3,942,640 | 3/1976 | Hellstrom | 206/469 |
| 4,091,921 | 5/1978 | Lewis | 206/459 |
| 4,150,744 | 4/1979 | Fennimore | 206/439 |
| 4,197,947 | 4/1980 | Zaidi | 206/807 |
| 4,209,095 | 6/1980 | Dutcher | 206/469 |
| 4,261,462 | 4/1981 | Wysocki | 206/45.31 |

*Primary Examiner*—William T. Dixson, Jr.
*Attorney, Agent, or Firm*—Charles E. Temko

[57] ABSTRACT

A sealable package for pharmaceutical and other products which will immediately reveal the presence of tampering. The package consists of a sealed envelope of thermoplastic film having a printed outline in which the sealing of the package is performed at the printed outline. After sealing, the film is shrunk tending to inflate the sealed area because of entrapped air. Should the package be ruptured the inflation is lost. Should the package be cut at the sealed area, it is impossible to reseal the package without a visual indication caused by irregularities in the printed area.

3 Claims, 2 Drawing Figures

TAMPER PROOF PACKAGING

BACKGROUND OF THE INVENTION

This invention relates generally to the field of product packaging, and more particularly to an improved tamper proof package, that is to say a package which will indicate the presence of tampering to a user upon a casual inspection.

The need for such packaging has been recognized for some time, and interest in such packaging has been heightened considerably by the prevalent alteration of nationally distributed proprietary pharmaceuticals with the intention of causig death or injury by unauthorized persons.

It is common practice to attractively package such items as aspirin and aspirin substitutes in a so called blister package which includes a fiberboard base and a synthetic resinous blister having peripheral edge portions which are sealed to the base. Such packaging is readily compromised by using a razor blade or other sharp instrument to cut the base at a peripheral edge, to reach the enclosed contents, and to reglue the cut edge. With care, the evidence of such activity can be adequately disguised.

Other expedients in the case of bottled products include the provision of a shrinkable collar which surround the screw cap of the container which must be torn or otherwise damaged before it can be removed from the neck of the container in order to open the cap. The material of which the collar is made can often be softened by heat, and again reshrunk upon the bottle without detection.

Still another attempted solution of the problem involves the use of a sensor containing a pH sensitive dye which displays a first color at normal atmosphere pH and a second color above normal atmosphere pH. An artificial atmosphere is introduced in the package which is released when the package is opened to change the color of the sensor. This method is, of course, inordinately expensive, and is justified only where the value of the contents of the container is high.

SUMMARY OF THE INVENTION

Briefly stated, the invention contemplates the provision of an improved package comprising a pair of synthetic resinous laminae which are heat sealed at peripheral edges thereof to enclose the packaged product. The areas of heat sealing are provided with a printed pattern prior to the sealing operation, so that if the sealed area is ruptured, the distortion of the printed pattern is readily apparent. Thereafter, the package is subjected to a heat shrinking operation causing entrapped air to inflate the sealed area. If the laminae are penetrated at any time thereafter, the package will no longer appear in inflated condition, again revealing the presence of possible tampering.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
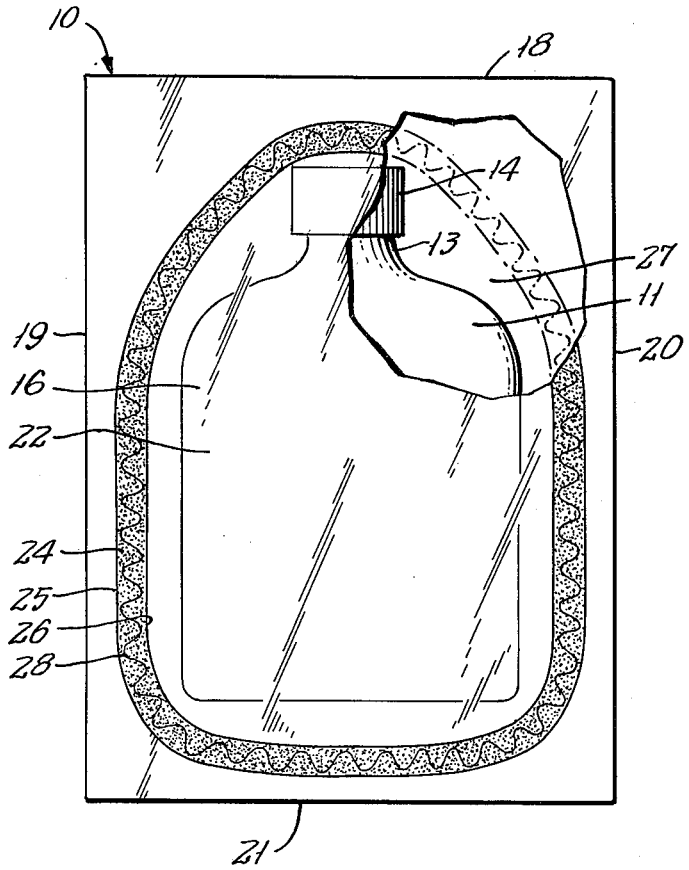
FIG. 1 is a front elevational view of an embodiment of the invention.
Figure 2:
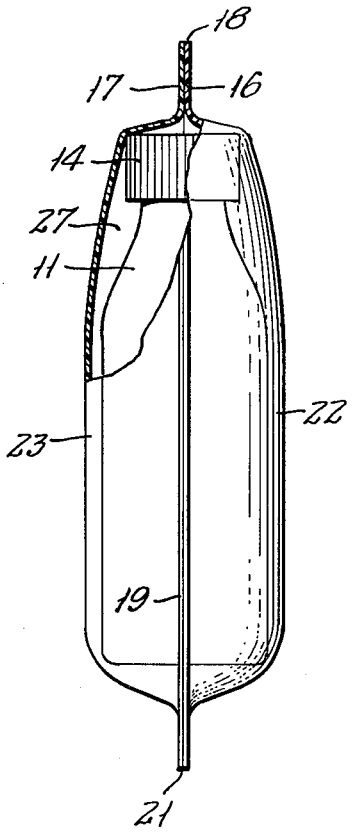
FIG. 2 is a side elevational view thereof.

In accordance with the invention, the tamperproof package, generally indicated by reference character 10 is used for enclosing a bottle 11, or other container containing a pharmaceutical or other product to be protected, the bottle including a neck portion 13 supporting a cap 14 in well known manner. The package 10 includes first and second laminae 16 and 17, which may be formed as two separate pieces, or as a result of folding a single piece of planar material. It is bounded by an upper edge 18, side edges 19 and 20, a lower or fold edge 21, as well as outer surfaces 22 and 23.

A continuous sealed area 24 is bounded by an outer edge 25 and an inner edge 26. This area is provided with continuous printing 28 on both laminae, most conveniently in the form of a simple continuous pattern, the distortion of which will be readily recognizable by a user.

The package is assembled by placing the bottle 12 between the laminae 16–17, and sealing the area 24 about the bottle. This is most conveniently accomplished using radio frequency energy in a suitable press (not shown) to result in a flexible balloon surrounding the bottle. During this sealing operation, a certain amount of air will be entrapped which will cause a small degree of inflation in the enclosed area 27.

Next, the package is subjected to a shrinking operation caused by placing the same in a heated atmosphere, causing the enclosed area 27 to more closely conform to the enclosed bottle 12 and causing a greater degree of inflation of the entrapped air.

The package 10 may be marketed in this condition, or enclosed within further packaging (not shown). A consumer purchasing the package may reach the contents by merely cutting the packaging 10 with a scissors or other instrument, and removing the bottle 12. Before this operation is performed, the consumer has an opportunity to inspect the package for signs of tampering. Such tampering will require either the cutting of the enclosed area 27 and reclosing the same, or cutting at the sealed area 24 and resealing the same. There is no other manner in which the bottle 12 can be reached.

If the former form of tampering is attempted, the package will immediately loose its inflation, and even if the package is in some way resealed, it will not be possible to reintroduce entrapped air without some form of additional seal which can be readily detected. If the latter course of action is attempted when an attempt is made to reseal the package, the printed pattern will be distorted, and this fact is also readily noticeable by the user. In either case, the consumer has sufficient warning not to use the contents of the package.

It is also possible to perform the printing in the area 24 using an ink of known type which is color sensitive to the presence of radioactivity. Should an attempt be made to irradiate the package without cutting the same, the change in color of the ink can be immediately detected to warn the user not to use the contents of the package.

I wish it to be understood that I do not consider the invention limited to the precise details of structure shown and set forth in this specification, for obvious modifications will occur to those skilled in the art to which the invention pertains.

I claim:

1. The method of forming a tamper proof protective packaging for an enclosed article comprising the steps of:

providing first and second planar laminae of heat and shrinkable material of sufficient area to enclose said article;

printing an area corresponding to a sealed curvilinear area on the outer surfaces of said laminae;

inserting said article between said laminae and hermetically sealing said laminae together over said printed curvilinear area to enclose said article; and subsequently heating said sealed laminae to shrink the same about said article, the shrinking causing entrapped air to inflate the areas of said laminae within the sealed areas;

whereby an attempt to cut such last mentioned area will cause deflation, and an attempt to cut the sealed area and reseal the same will visibly distort the printing on said sealed area.

2. In the method of claim 1, the additional step of printing with an ink which is color sensitive to the presence of radioactivity.

3. As a new article of manufacture, a tamperproof package comprising: an enclosed article; a pair of flexible planar laminae, the peripheral area of which are heat-sealed to enclose said article, the heat-sealed areas having a printed pattern on the exposed surfaces thereof; said laiminae being inflated inwardly of said heat-sealed areas by air and trapped during a sealing operation, and further inflated by a subsequent heat-shrinking operation.

* * * * *